US006520095B1

(12) United States Patent
Hayes

(10) Patent No.: US 6,520,095 B1
(45) Date of Patent: Feb. 18, 2003

(54) SHELF SUPPORT

(76) Inventor: Lowell Hayes, P.O. Box 727, Valle Crucis, NC (US) 28691

( * ) Notice: Subject to any disclaimer, the term of this patent is extended or adjusted under 35 U.S.C. 154(b) by 0 days.

(21) Appl. No.: 09/951,574

(22) Filed: Sep. 14, 2001

(51) Int. Cl.[7] ..... A47B 91/00
(52) U.S. Cl. ..... 108/190; 211/194; 211/188
(58) Field of Search ..... 108/180, 186, 108/192, 193, 190, 157.18, 158.12, 91; 211/194, 189, 188, 186; 312/108, 107, 265.5, 257.1

(56) References Cited

U.S. PATENT DOCUMENTS

| | | | | | |
|---|---|---|---|---|---|
| 746,915 | A | * | 12/1903 | Bauch | 312/108 |
| 753,678 | A | * | 3/1904 | Dannenberg | 108/190 |
| 761,103 | A | * | 5/1904 | Richards | 312/108 |
| 773,161 | A | * | 10/1904 | Priesmeyer | 312/108 |
| 3,141,423 | A | * | 7/1964 | Christiansen | 108/190 |
| 3,316,862 | A | * | 5/1967 | Dismuke | 108/91 |
| 3,644,008 | A | * | 2/1972 | Overby | 312/107 |
| 3,834,342 | A | * | 9/1974 | Schoell | 440/41 |

FOREIGN PATENT DOCUMENTS

| | | | | |
|---|---|---|---|---|
| FR | 1108777 | * | 1/1956 | 211/188 |
| GB | 137391 | * | 1/1920 | 211/188 |

* cited by examiner

*Primary Examiner*—Janet M. Wilkens
*Assistant Examiner*—Jerry A. Anderson
(74) *Attorney, Agent, or Firm*—Richard L Huff

(57) ABSTRACT

Shelf support system in which "T"-shaped mid base members and support members and "L"-shaped end base members and support members have inner sections which contact and hold a shelf board and outer sections containing alternating extensions and indentions so that adjacent base members and support members interlock with each other. The shelf system may thus be assembled without tools. The rear aspects of base members are angled forwardly and downwardly and the side aspect of end base members are angled inwardly and downwardly to allow the shelf system to clear a baseboard and/or molding along a wall so that the main portion of the shelf unit may fit flush against the wall. The shelf support system is suitable for use with standard shelf boards of any length.

8 Claims, 8 Drawing Sheets

SHELF SUPPORT

BACKGROUND OF THE INVENTION

1. Field of the Invention

This invention relates to a free-standing shelf support system which is versatile, easy to install, inexpensive, simple in design, sturdy, and capable of standing flush with walls that have baseboards and/or moldings.

2. Description of the Related Art

Systems to support shelves and to keep them vertically aligned and separated from each other are well known in the art. U.S. Pat. No. 3,693,556 to Rous shows "T"-shaped vertical risers, cross members extending between the risers, and trays suspended from the cross members to form shelves. These units are made of pieces having complicated shapes, leading to expensive manufacturing processing. U.S. Pat. No. 4,125,338, issued to Lew, discloses a system in which each shelf board and each partition contains a hole capable of accepting the arms of a cross in order to keep the partitions and shelves in a constant fixed relationship. Additionally, each shelf and each partition contains rail-like protrusions which fit into grooves of connecting bars to provide a sturdy connection. The user of this system is limited to boards which come with the supporting units or else must prepare holes for the cross using accurate measurements. U.S. Pat. No. 4,651,651 to Sheffer discloses a shelving system having sides with indentations for the shelves and multiple shelves which fit into the indentations. This system is extremely limited as to the size and configuration of the units which may be prepared and the finished unit could not fit flush against walls having baseboards. This causes a problem in that items laid on top of the system can fall between the system and the wall due to the fact that the system must stand away from the wall a distance at least equal to the width of the baseboard and/or molding. U.S. Pat. No. 5,865,126 to Miranda discloses a shelving system wherein the sides are made from interlocking modular elements. The elements are so constructed as to form slots which will hold shelves. Distances between the shelves may be varied depending upon the number of elements used. The finished unit could not fit flush against walls having baseboards. Also, this system provides only side support for the shelves and no support in the back of the unit. U.S. Pat. No. 6,126,022 to Merkel discloses a shelf system having shelves, support pieces, and a rear having slots and tabs. These parts interlock to form the finished unit. The number of possible variations is extremely limited and the finished unit could not fit flush against a wall having a baseboard.

SUMMARY OF THE INVENTION

The present invention is drawn to a system for supporting shelves which avoids the shortcomings of the above related systems. With the use of this system, no tools are required in the assembly of a series of shelves. The system is versatile, being capable of use with standard shelf boards and lumber having any length and a variety of vertical spacings. This system is safe strong, inexpensive to manufacture, and easy to use. The shelf boards and the support system need not be purchased as a unit. The finished unit is capable of having its side and rear fit flush against a wall having a baseboard.

The system of the present invention is made up of members which may be placed under and above shelf boards in order to secure the boards. The several members making up the system are: two end base members, mid base members in the number required, two "L"-shaped support members for the left and right sides for each shelf level, and "T"-shaped support members for mid support for each shelf level in the number required.

These members fit together without the use of tools or fasteners to form a shelf unit which is capable of varying at the user's option in height, width, and depth. The base members are so shaped as to allow the side and rear of the system to fit flush against walls even though the walls have baseboards and/or molding.

Understanding of this invention will be enhanced by reference to the following drawing wherein like reference numerals will refer to like elements throughout the following description.

DESCRIPTION OF THE PREFERRED EMBODIMENTS

Figure 1:
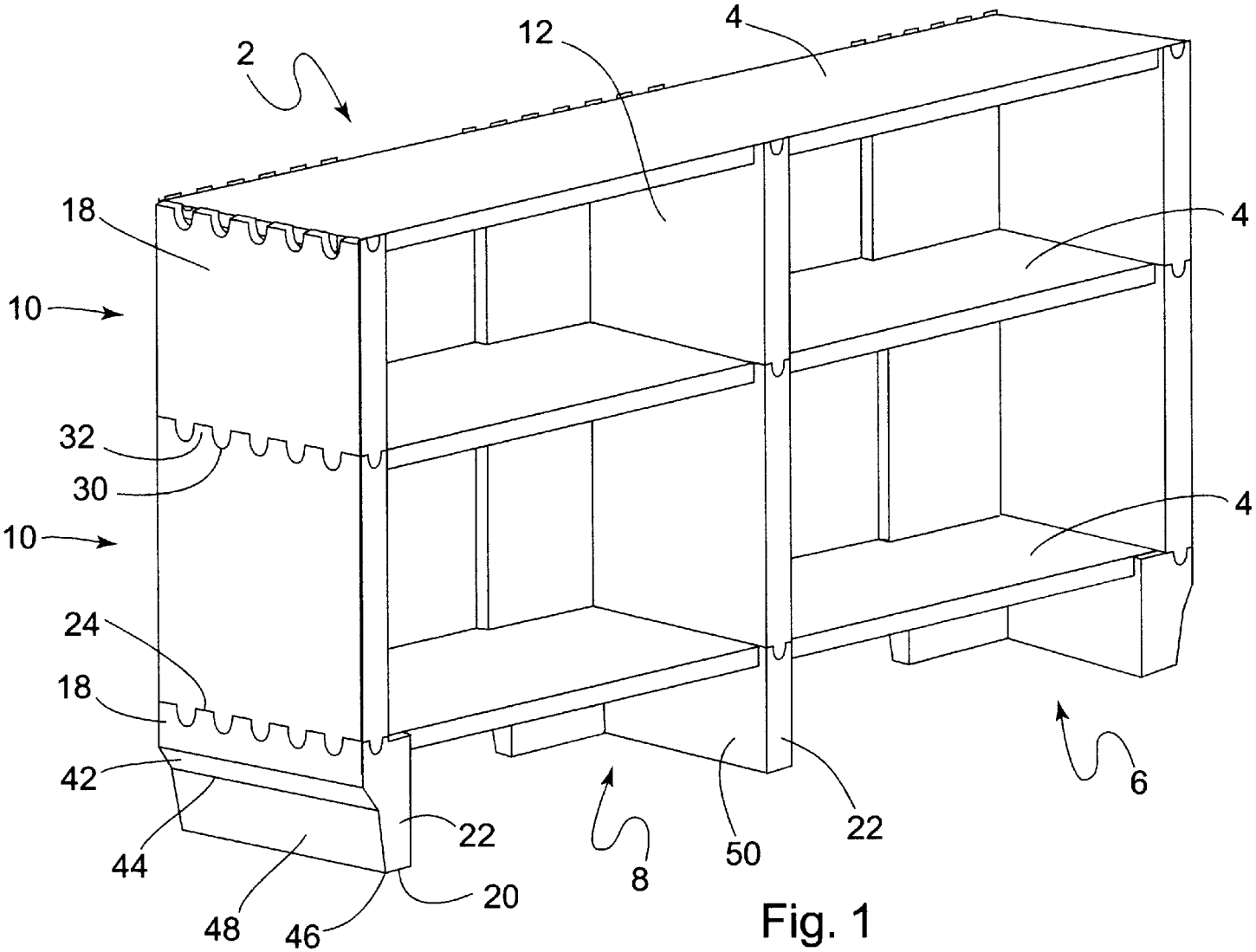
FIG. 1 is a front/side elevational perspective view of a system according to this invention with a top shelf in place.
Figure 2:
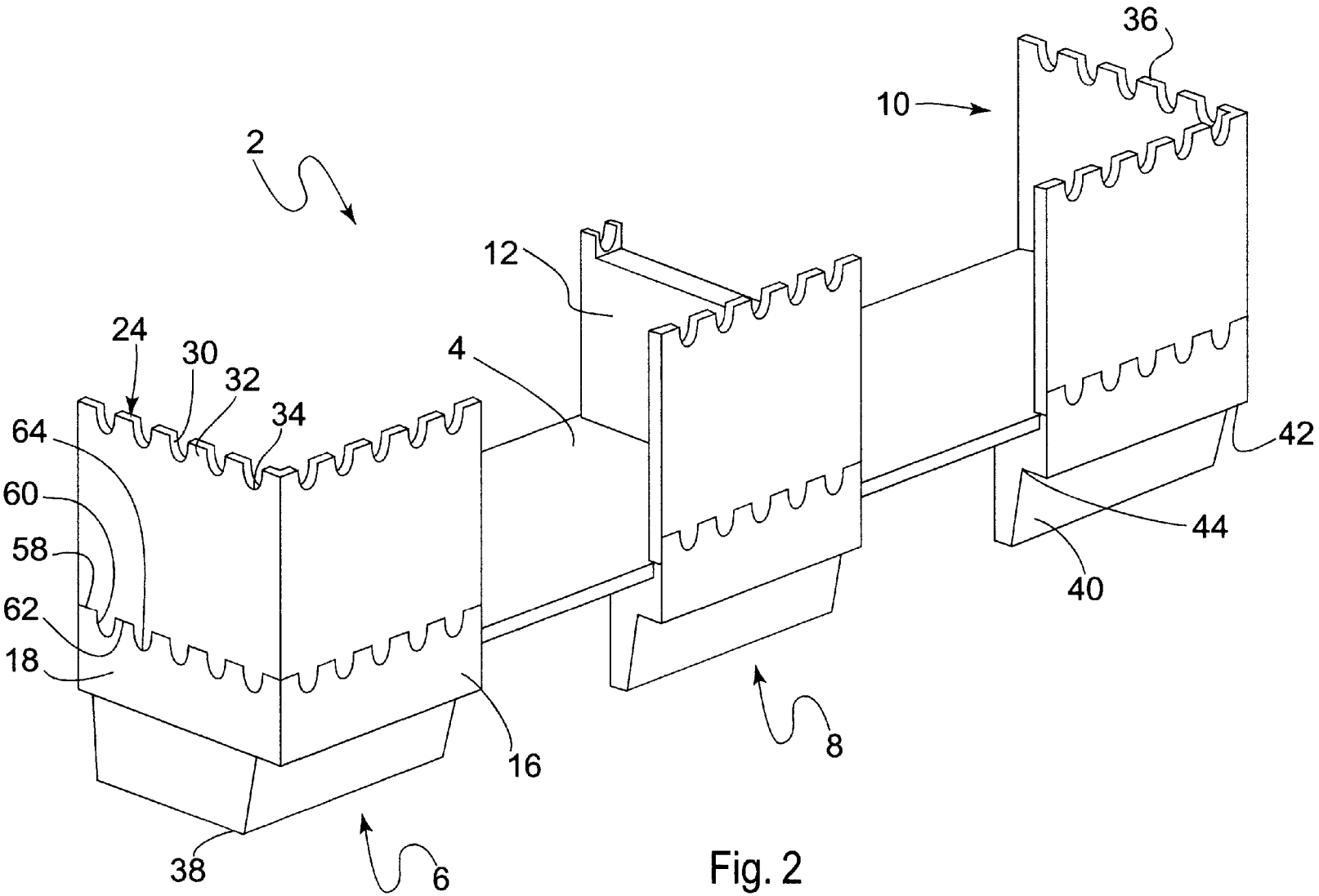
FIG. 2 is a rear/side elevational view of a system according to this invention with the top shelf removed.
Figure 4:
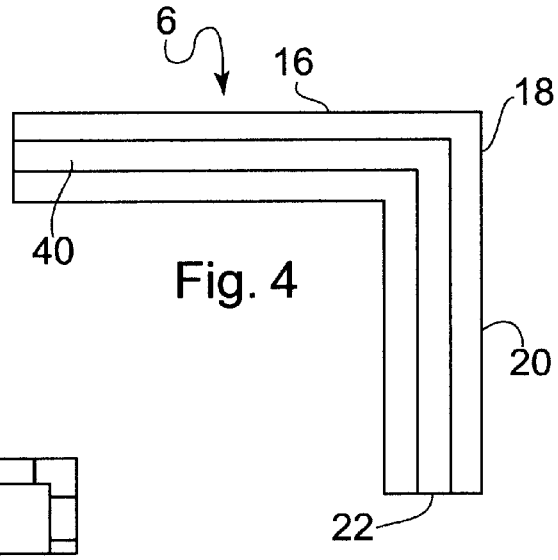
FIG. 4 is a bottom plan view of an end base member.

Reference to FIGS. 1 and 2 offers a general overall view of the system 2 according to the present invention. The system 2 of FIG. 1 provides shelves 4 supported by two "L"-shaped end base members 6, at least one "T"-shaped mid base member 8, two "L"-shaped end support members 10 for the left and right sides for each shelf level, at least one "T"-shaped mid support member 12 for each shelf level, and one top shelf 4. The system 2 of FIG. 2 is essentially the same as that of FIG. 1, but with the top shelf removed to show detail.

Referring to FIGS. 1–6, the end base members 6 will be described.

Figure 3:
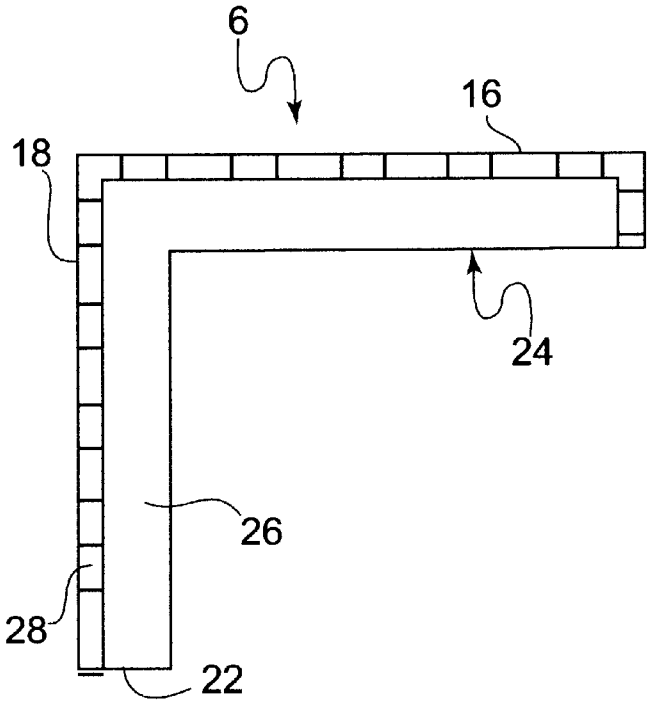
FIG. 3 is a top plan view of an end base member.
Figure 6:
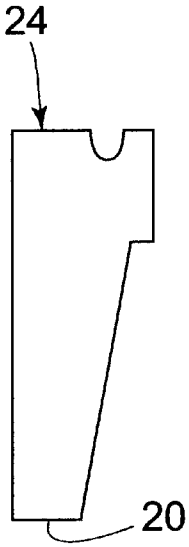
FIG. 6 is an elevational view of the front edge of an end base member.
Figure 5:
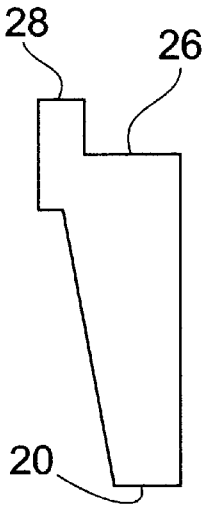
FIG. 5 is a cross-sectional view of an end base member.

Each end base member 6 is "L"-shaped and contains a rear surface 16, a side surface 18, a bottom surface 20, a front surface 22, and an upper surface 24. In top plan view as shown in FIG. 3, each end base member 6 contains an upper surface 24 made up of an inner, shelf-supporting, upper section 26 and an outer, interlocking, upper section 28. The shelf-supporting upper section 26 occupies greater than 50% of the upper surface 24 and finds utility in supporting the weight of the bottom shelf 4.

The interlocking upper section 28 contains "U"-shaped indentations 30 and flat-topped extensions 32. The particular shapes of the indentations 30 and extensions 32 are not critical as long as they interlock with opposing pieces. The lower ends 34 of the indentations 30 extend as low as, preferably nearly as low as, the level of the shelf-supporting upper section 26. The upper end 36 of the flat-topped extensions 32 extend above the level of the shelf-supporting section 26 a distance equal to, or preferably nearly equal to, the thickness of a shelf 4 to be held by the system 2. The interlocking upper section 28 contains indentations 34 and extensions 32 on the top of the front 22, side 18, and rear 16 surfaces to provide a solid supporting fit with the next higher "L"-shaped end support member 10.

The side and front view of the end base member 6 are best seen in FIG. 1 and the side and rear view of the end base member 6 are best seen in FIG. 2.

The front surface 22 is straight from the bottom surface 20 to the upper surface 24.

Regarding the rear surface 16, the side surface 18 is narrower at the bottom surface 20 than at the upper surface 24. The upper dimension, or depth, is typically 10 or 12 inches long. The bottom dimension may vary so as to clear baseboards. The bottom surface 20 ends at a point 38 which is sufficient to clear the baseboard and/or molding. The inclined rear surface 40 extends upwardly and rearwardly at an angle designed to clear the baseboard and/or molding. The inclined rear surface 40 meets with an overhang 42 which extends from this juncture 44 to the rear surface 16. The thus-created cavities are sufficient to allow the shelving system 2 to stand flat on the supporting surface, stand flush against the wall, and clear the baseboard and/or molding.

As to the side surface 18, the front 22 and rear 16 surfaces are narrower at the bottom surface 20 than at the upper surface 24. The difference between the dimension of the upper surface 24 and the dimension of the bottom surface 20 is sufficient to allow the system 2 to stand flush against a wall containing a baseboard and/or molding. The bottom surface 20 ends at a point 46 which is sufficient to clear the baseboard and/or molding. The inclined side surface 48 extends upwardly and outwardly at an angle designed to clear the baseboard and/or molding. The inclined side surface 48 meets with an overhang 42 which extends from this juncture 44 to the side surface 18. The thus-created cavities are sufficient to allow the shelving system 2 to stand flat on the supporting surface, stand flush against the wall, and clear the baseboard and/or molding both on the sides and the rear. This saves floor space while avoiding the possibility of presenting a gap between the system 2 and the wall which would allow articles to fall between the system 2 and the wall.

With reference to FIGS. 1, 2, and 7–9, the mid base members 8 will be described.

Figure 7:
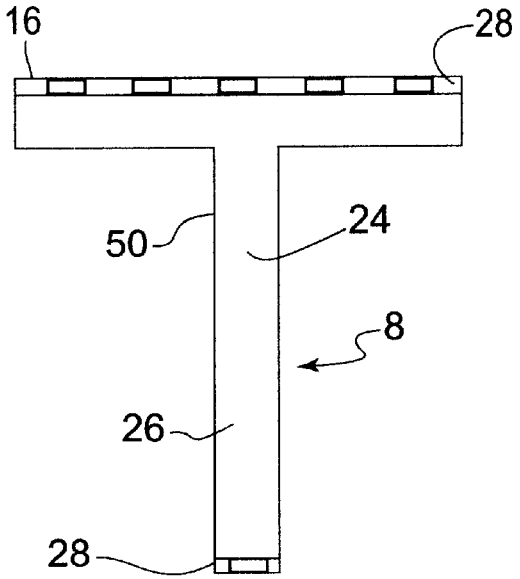
FIG. 7 is a top plan view of a mid base member.
Figure 8:
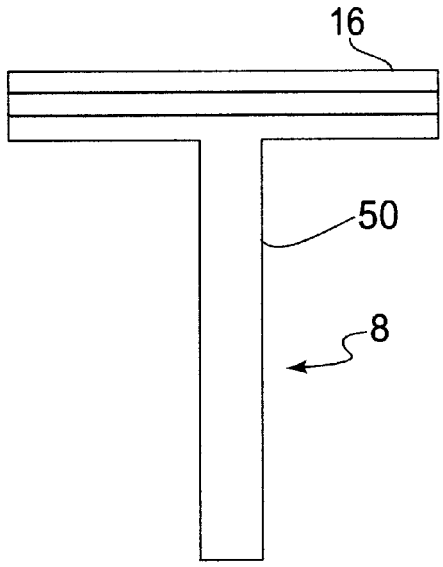
FIG. 8 is a bottom plan view of a mid base member.
Figure 9:
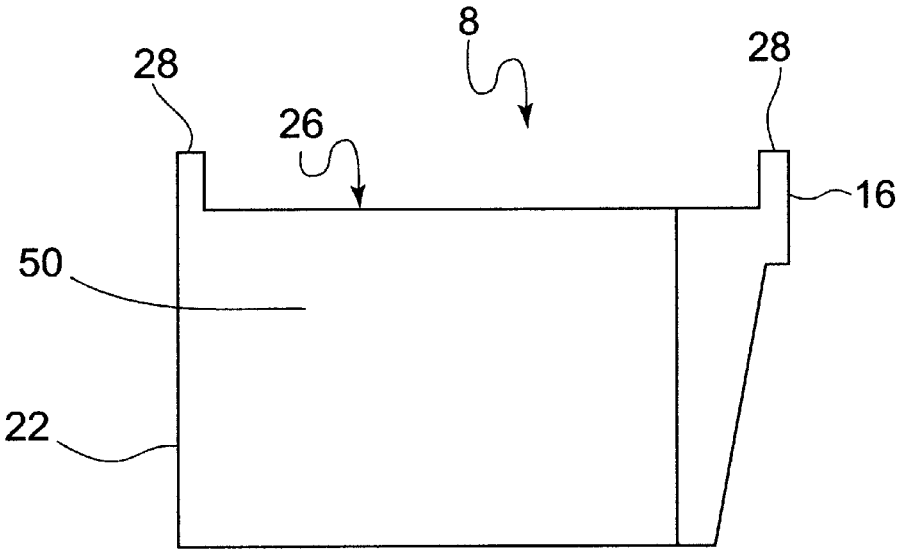
FIG. 9 is a side elevation view of a mid base member.

FIG. 7 shows a top plan view of the mid base member 8. FIG. 8 shows a bottom plan view of the base member 8. FIG. 9 shows a side view of the mid base member 8. These members 8 fit at the same level as the end base members, 6 but fit between the end base members 6 in order to give support to the intermediate portion of the shelf system 2, as needed.

In top plan view as shown in FIG. 7, the mid base member 8 is "T"-shaped. Each mid base member 8 contains an upper surface 24 made up of an inner, shelf-supporting, upper section 26 and an outer, interlocking, upper section 28.

Each mid base member 8 contains a rear surface 16, two side surfaces 50, and a front surface 22. The shelf-supporting upper section 26 occupies all but the front 22 and rear 16 surfaces of the upper surface and finds utility in supporting the weight of the bottom shelf 4. The interlocking upper section 28 contain "U"-shaped indentations 30 and flat-topped extensions 32. The particular shapes of the indentations 30 and extensions 32 are not critical as long as they interlock with opposing pieces. The lower ends 34 of the indentations 30 extend as low as, or preferably nearly as low as, the level of the shelf-supporting upper section 26. The upper end 36 of the flat-topped extensions 32 extend above the level of the shelf-supporting section 26 a distance equal to, or preferably nearly equal to, the thickness of a shelf 4 to be held by the system 2. The interlocking upper section 28 contains a least one, preferably just one, indentation 30 or extension 32, preferably a indentation 30, on the front surface 22 and alternating indentations 30 and extensions 32 on the rear surface 16 to provide a solid supporting fit with the next higher "T"-shaped mid support member 12. As shown in FIG. 9, the same cavity-forming configuration is present at the rear surface 16 of the mid base member 8 as is present at the rear surface 16 of the end base members 6. These cavities allow the finished system 2 to stand flat on the supporting surface, stand flush against the wall, and clear the baseboard and/or molding. This saves floor space while avoiding the possibility of presenting a gap between the system 2 and the wall which would allow articles to fall between the system 2 and the wall.

The "L"-shaped end support members 10 for the right and left sides for levels above the base level are shown in FIGS. 1, 2, 10, and 11.

Figure 10:
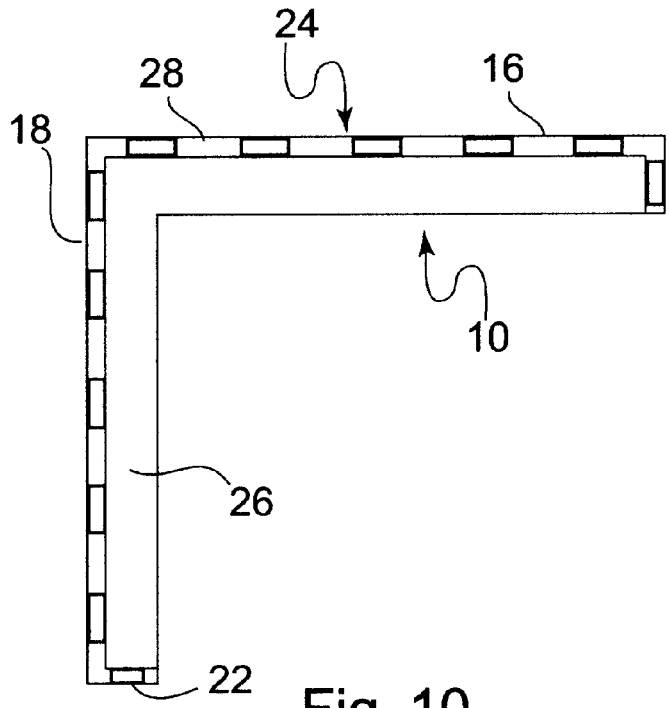
FIG. 10 is a top plan view of an end support member.
Figure 11:
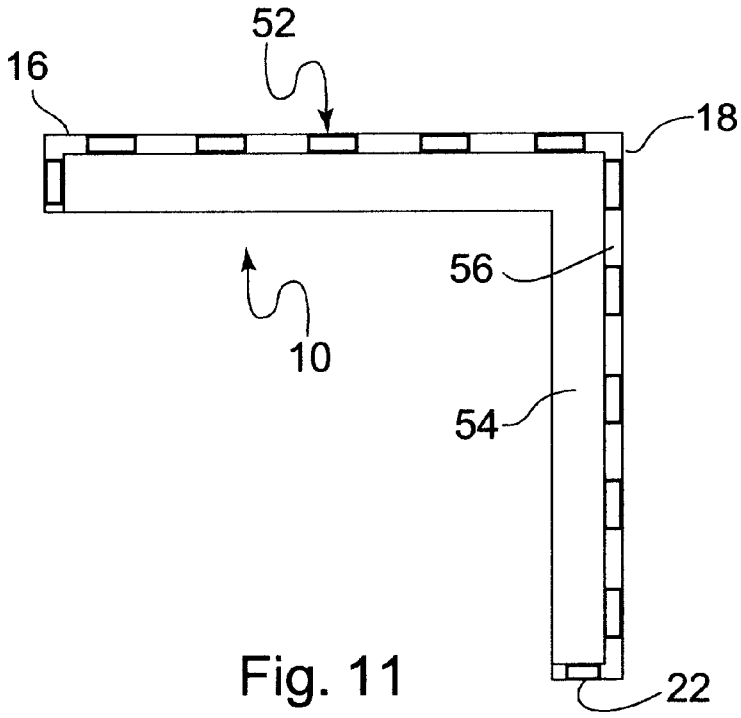
FIG. 11 is a bottom plan view of an end support member.

In top and bottom plan views as shown in FIGS. 10 and 11, each end support member 10 contains an upper 24 and lower 52 surface made up of an inner, upper 26 and lower 54 shelf-contacting sections and outer upper 28 and lower 56 interlocking sections. Each end support member 10 is "L"-shaped and contains a rear surface 16, a side surface 18, and a front surface 22. The upper 26 and lower 54 shelf-contacting sections occupy greater than 50% of the upper 24 and lower 52 surfaces and find utility in supporting the weight of the upper shelves 4 and holding down the lower shelves 4. The outer interlocking upper sections 28 contain "U"-shaped indentations 30 and flat-topped extensions 32 while the interlocking lower sections 56 contain flat-topped indentations 58 and "U"-shaped extensions 60. The particular shapes of the indentations 30 58 and extensions 32 60 are not critical as long as they interlock with opposing pieces.

Regarding the indentations 30 and extensions 32 on the upper surface 24, the lower ends 34 of the "U"-shaped indentations 30 extend as low as, or preferably nearly as low as, the upper shelf-contacting surface 26. The upper end 36 of the flat-topped extensions 32 extend above the shelf-contacting surface 26 a distance equal to, or preferably nearly equal to, the thickness of a shelf 4 to be held by the system 2. The interlocking upper section 28 of the upper surface 24 contains indentations 30 and extensions 32 on the front 22, side 18, and rear 16 surfaces to provide a solid supporting fit with the next higher "L"-shaped support member 10.

Regarding the indentations 58 and extensions 60 of the lower surface 52, the upper ends 62 of the flat indentations 58 are at the level of, or preferably nearly at the level of, the lower shelf-contacting surface 52. The lower ends 64 of the "U"-shaped extensions 60 extend below the lower shelf-contacting section 54 a distance equal to, or preferably nearly equal to, the thickness of a shelf 4 to be held by the system 2. The interlocking upper 28 and lower 56 sections contain indentations 30 58 and extensions 32 60 on the front 22, side 18 and rear 16 surfaces to provide a solid supporting fit with the next higher and next lower "L"-shaped shelf-contacting member 10 respectively.

The "T"-shaped mid support members 12 are seen in FIGS. 1, 2, 12, and 13.

Figure 12:
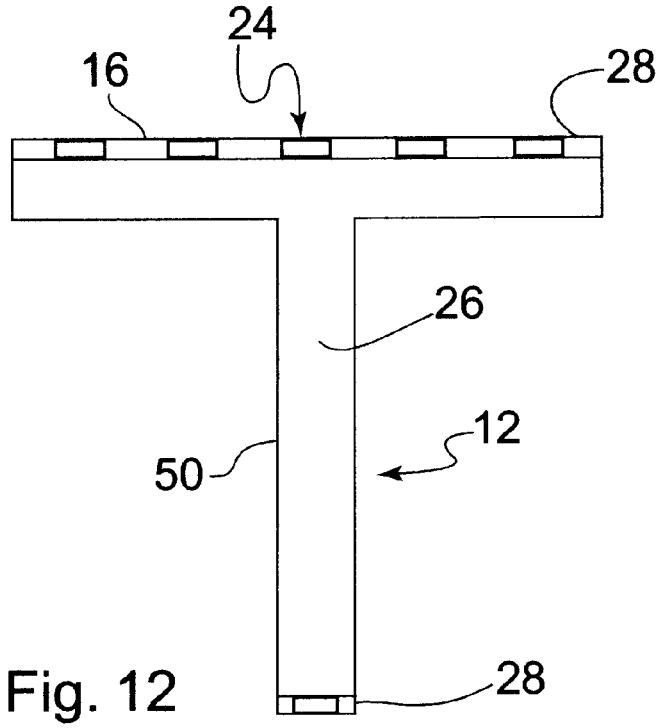
FIG. 12 is a top plan view of a mid support member.
Figure 13:
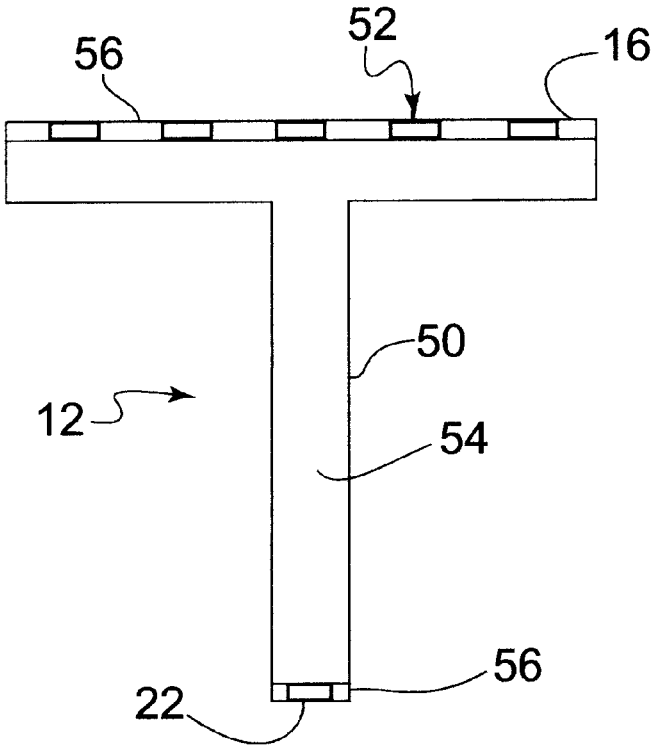
FIG. 13 is a bottom plan view of a mid support member.
Figure 14:
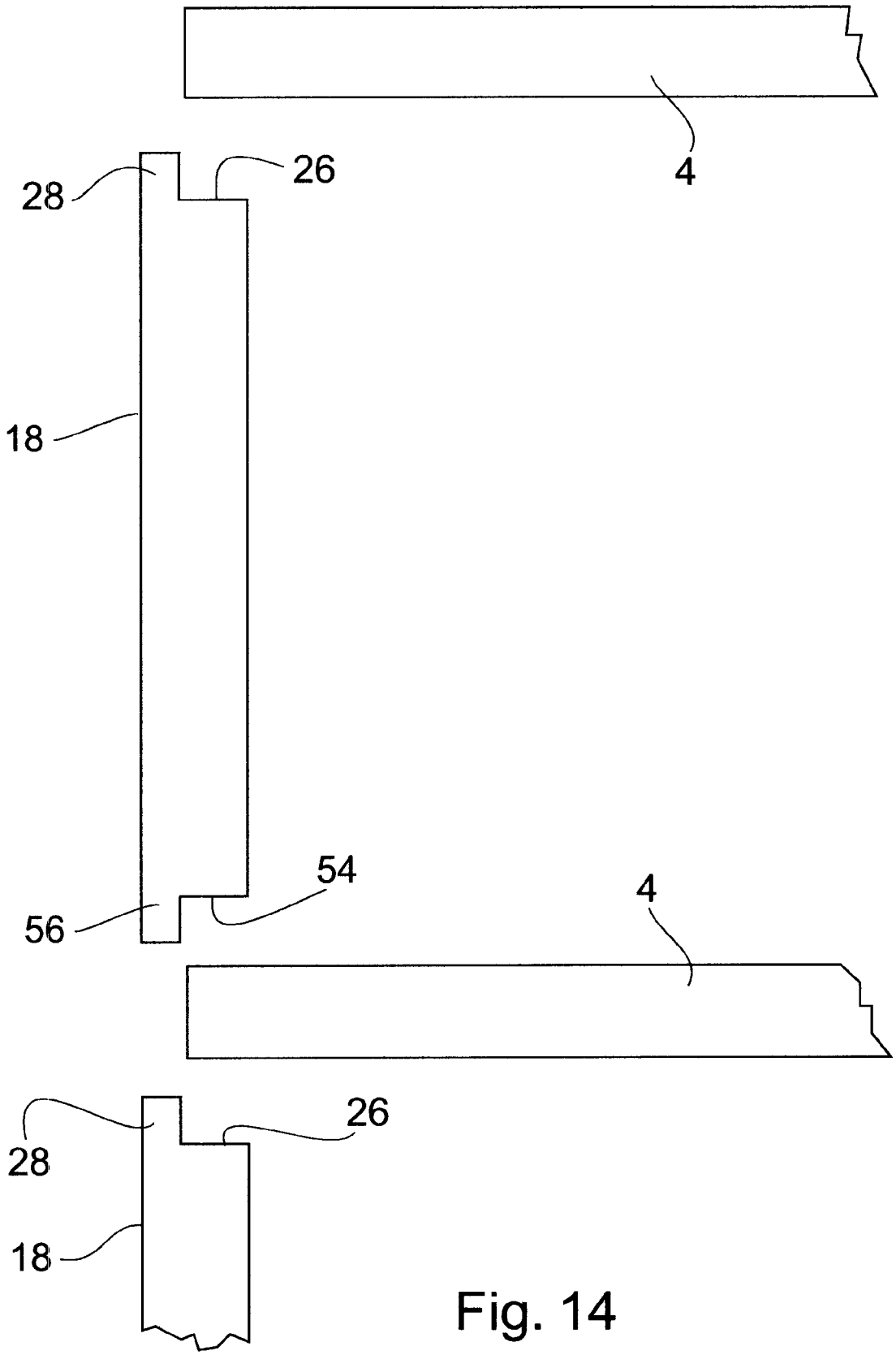
FIG. 14 is an exploded cross-sectional view depicting the relationship between members of the system and common ¾" shelf boards.
Figure 16:
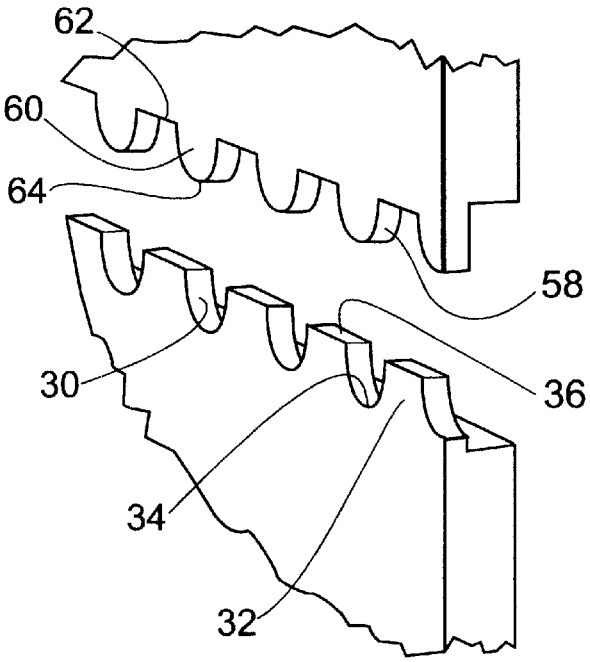
FIG. 16 is an exploded elevational perspective view showing the relationship between the extensions and indentations of abutting members.
Figure 15:
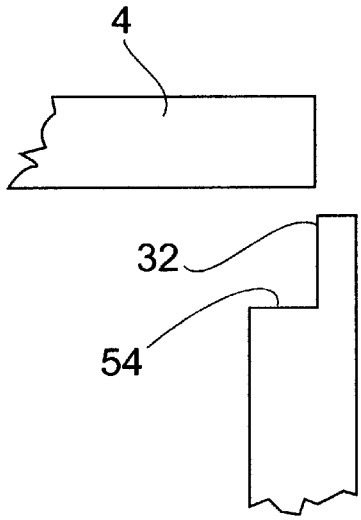
FIG. 15 is an exploded cross-sectional view depicting the relationship between modified members of the system and 1½" shelf boards.
Figure 17:
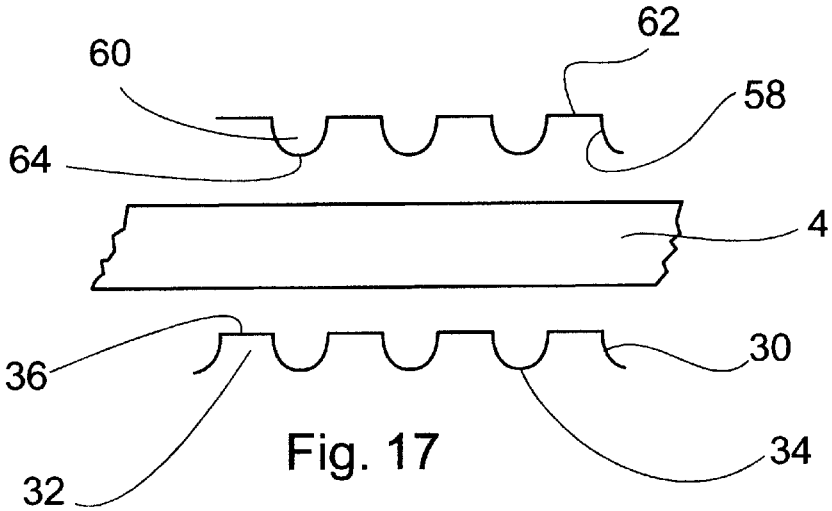
FIG. 17 is an exploded side view showing the relationship between the extensions and indentations of abutting members.

FIG. 12 shows a top plan view of the mid support member 12, FIG. 13 shows a bottom plan view of the mid support member 12, FIGS. 1 and 2 show perspective views of the mid support members 12, and FIGS. 16 and 17 show detailed, exploded views of the indentations 30 58 and extensions 32 60. These support members 12 fit at the same level as the end support members 10, but fit between the end support members 10 as needed in order to give support to the intermediate portion of the shelf system 2.

In plan view, the mid support member 12 is "T"-shaped. In plan view, each mid support member 12 contains an upper 24 and lower surface 52. The upper surface 24 is made up of an inner, shelf-contacting, section 26 and an outer, interlocking, section 28. The lower surface 52 is made up of an inner, shelf-contacting section 54 and an outer, interlocking, section 56. Each mid support member 12 contains a rear surface 16, two side surfaces 50, and a front surface 22. The upper 26 and lower 54 shelf-contacting sections occupy all but the front 22 and rear 16 surfaces of the upper 24 and lower 52 surfaces and find utility in contacting and holding shelves 4. The interlocking upper section 28 contains "U"-shaped indentations 30 and flat-topped extensions 32. The interlocking lower section 56 contains "U"-shaped extensions 60 and flat-topped indentations 58. The particular shapes of the indentations 30 58 and extensions 32 60 are not critical as long as they interlock with opposing pieces.

Regarding the upper surface 24 of the mid support members 12, the lower ends 34 of the indentations 30 extend as low as, or preferably nearly as low as, the upper shelf-contacting surface 26. The upper ends 36 of the flat-topped extensions 32 extend above the shelf-contacting surface 26 a distance equal to, or preferably nearly equal to, the thickness of a shelf 4 to be supported by the system 2. The interlocking upper section 28 of the upper surface 24 contains indentations 30 and extensions 32 on the front 22 and rear 16 surfaces to provide a solid supporting fit with the next higher "T"-shaped support member 12.

Regarding the indentations 58 and extensions 60 of the lower surface 52, the upper ends 62 of the flat indentations 58 are at or near the level of the lower shelf-contacting surface 52. The lower ends 64 of the "U"-shaped extensions 60 extend below the lower shelf-contacting section 54 a distance equal to or nearly equal the thickness of a shelf 4 to be held by the system 2. The interlocking upper 28 and lower 56 sections contain indentations 30 58 and extensions 32 60 on the front 22 and rear 16 surfaces to provide a solid supporting fit with the next higher and next lower "T"-shaped shelf-contacting member 12 respectively.

The interlocking upper section 28 contains a least one, preferably just one, indentation 30 or extension 32, preferably an indentation 30, on the front surface 22 and alternating indentations 30 and extensions 32 on the rear surface 16 to provide a solid supporting fit with the next higher "T"-shaped mid support member 12.

The interlocking lower section 56 contains at least one, preferably just one, indentation 58 or extension 60, on the front surface 22 and alternating indentations 58 and extensions 60 on the rear surface 16 to provide a solid supporting fit with the next lower "T"-shaped support member.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A system for use in supporting shelves on a supporting surface, comprising: two "L"-shaped side base members having an upper surface with inner and outer sections, the inner sections being capable of contacting and supporting a shelf and the outer sections containing alternating indentations and extensions and for each layer of shelving above the base member, two"L"-shaped end supports having upper and lower surfaces, each upper and lower surface having inner and outer sections, the inner section section of the lower surface being capable of contacting and holding a shelf, the inner section of the upper surface being capable of contacting and supporting another shelf and the outer sections containing alternating indentations and extensions for cooperation with the extensions and indentations of other L-shaped end supports or the L-shaped side base members.

2. The system of claim 1, wherein there is at least one mid base member located between the side base members and, for each layer of shelves, at least one mid support member located between the end support members.

3. The system of claim 2, wherein each mid base member contains a side surface, a straight front surface, a rear surface having a straight portion, a bottom surface having a straight portion, and a top surface, and the straight portion of the bottom surface is shorter in length than the top surface, and the straight portion of the rear surface is shorter in length than the front surface, there being a cavity in the bottom rear portion of the base member.

4. The system of claim 3, wherein the mid base member is "T"-shaped in plan view and contains inner sections and outer sections, the inner sections being capable of contacting and holding shelves and the outer sections having alternating extensions and indentations.

5. The system of claim 3, wherein each end base member contains a straight front surface, a rear surface having a straight portion, a bottom surface, and a top surface and the bottom surfaces of the front and rear surfaces are shorter in length than the top surfaces of the front and rear surfaces, there being a cavity in the bottom side portion of the end base member.

6. The system of claim 5 wherein the mid support member is "T"-shaped in plan view and contains inner surfaces and outer surfaces, the inner surfaces being capable of contacting and holding shelves and the outer surfaces having alternating extensions and indentations for cooperation with indentations and extensions of a mid base member or a mid support member.

7. The system of claim 6 wherein the height of the extensions and indentations is equal to or nearly equal to the thickness of a shelf to be held by the system.

8. The system of claim 7, in which the system contains shelves.

* * * * *

UNITED STATES PATENT AND TRADEMARK OFFICE

CERTIFICATE OF CORRECTION

PATENT NO. : 6,520,095 B2
DATED : February 18, 2003
INVENTOR(S) : Hayes

It is certified that error appears in the above-identified patent and that said Letters Patent is hereby corrected as shown below:

Column 6,
Line 22, "section section" should read -- section --.

Signed and Sealed this

Twenty-fifth Day of March, 2003

JAMES E. ROGAN
*Director of the United States Patent and Trademark Office*